US010508248B2

(12) United States Patent
Housel et al.

(10) Patent No.: US 10,508,248 B2
(45) Date of Patent: Dec. 17, 2019

(54) LUBRICANT COMPOSITION FOR HIGH-TEMPERATURE APPLICATIONS

(71) Applicant: Zschimmer & Schwarz, Inc., Milledgeville, GA (US)

(72) Inventors: Tyler Housel, Landsdale, PA (US); Nicholas Housel, Philadelphia, PA (US); Edward Cass, Blue Bell, PA (US)

(73) Assignee: Zschimmer & Schwarz, Inc., Milledgeville, GA (US)

( * ) Notice: Subject to any disclaimer, the term of this patent is extended or adjusted under 35 U.S.C. 154(b) by 81 days.

(21) Appl. No.: 15/816,111

(22) Filed: Nov. 17, 2017

(65) Prior Publication Data

US 2018/0142178 A1 May 24, 2018

Related U.S. Application Data

(60) Provisional application No. 62/423,626, filed on Nov. 17, 2016.

(51) Int. Cl.

*C10M 105/38* (2006.01)
*C10M 105/36* (2006.01)
*C10M 105/32* (2006.01)

(52) U.S. Cl.

CPC ..... *C10M 105/38* (2013.01); *C10M 105/32* (2013.01); *C10M 105/36* (2013.01); *C10M 2207/2835* (2013.01); *C10M 2207/2855* (2013.01); *C10M 2215/064* (2013.01); *C10M 2215/065* (2013.01); *C10M 2215/223* (2013.01); *C10M 2223/043* (2013.01); *C10M 2223/047* (2013.01); *C10N 2220/13* (2013.01); *C10N 2230/04* (2013.01); *C10N 2230/10* (2013.01); *C10N 2230/74* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,707,944 | A | 1/1998 | Yokouchi et al. | |
| 5,916,853 | A * | 6/1999 | Hamori | C10M 169/00 508/439 |
| 2004/0242439 | A1 * | 12/2004 | Mikami | C10M 169/02 508/480 |
| 2009/0298731 | A1 * | 12/2009 | Housel | C10M 105/38 508/485 |
| 2014/0254968 | A1 | 9/2014 | Nakagawa et al. | |
| 2015/0353862 | A1 | 12/2015 | Ohno | |

OTHER PUBLICATIONS

International Search Report/Written Opinion issued by the U.S. Patent & Trademark Office as International Search Authority dated Feb. 16, 2018 (9 pages).

* cited by examiner

*Primary Examiner* — Ellen M McAvoy
*Assistant Examiner* — Chantel L Graham
(74) *Attorney, Agent, or Firm* — Smith, Gambrell & Russell, LLP

(57) ABSTRACT

A lubricant composition is provided that has reduced deposit formation and a low evaporation allowing for improved performance in high temperature applications relative to conventional high temperature lubricants. The high temperature lubricant composition includes a base oil, wherein the base oil includes at least one polyol ester and at least one pyromellitate ester. In some embodiments, the lubricant composition further includes one or more additives selected from the group of an extreme-pressure additive, an anti-wear additive, an anti-rust additive, a corrosion inhibitor, and an antioxidant, or a combination thereof. Further provided are methods for lubricating an apparatus using the lubricant composition, methods for improving the operational lubrication of a conventional high temperature lubricant, and methods of preparing the high temperature lubricant composition of the present invention.

18 Claims, 3 Drawing Sheets

| | | | | | |
|---|---|---|---|---|---|
| Rim | 0 | 1 | 1 | 2 | 4 |
| Side | 0 | 1 | 3 | 3 | 4 |
| Total | 0 | 2 | 4 | 5 | 8 |

LUBRICANT COMPOSITION FOR HIGH-TEMPERATURE APPLICATIONS

FIELD OF THE INVENTION

The present invention relates to lubricants. More specifically, the present invention relates to a lubricant composition for use in high temperature applications, wherein the lubricant composition exhibits low deposit formation and low evaporation relative to conventional high-temperature lubricant compositions.

BACKGROUND OF THE INVENTION

Lubricants used in high temperature environments must exhibit low evaporation such that effective lubrication is maintained for an extended period to ensure the proper functioning of the lubricated equipment and to prevent damage thereto. Lubricants that evaporate quickly require the apparatus to be more frequently lubricated to replace the evaporated lubricant. Furthermore, high temperature lubricants must exhibit low deposit formation as deposits can inhibit rather than facilitate movement of lubricated parts. However, many conventional lubricants oxidize when used at high temperatures, which causes the formation of hard, lacquer-like deposits. The formation of deposits negatively impacts movement of the lubricated surfaces and necessitates periodic cleaning to remove the deposits, which can be time-consuming and inconvenient. Maximizing one property of a lubricant often sacrifices performance in the other property, so the key for optimal lubricant performance is to achieve a formulation that has both low evaporation and minimal deposit formation.

The choice of base oil used in the lubricant composition plays an important role in determining the amount and type of deposit formation that will occur when the lubricant composition is used in high temperature applications. Various base oils are used to create lubricant compositions including but not limited to mineral oils, vegetable oils, synthetic hydrocarbons, polyol esters, synthetic esters, complex esters, polyglycols, alkylated aromatics, and silicones. Ester fluids, specifically synthetic esters, are particularly useful as high temperature lubricants. Esters are useful in high temperature applications because other base oils suffer from high evaporation, smoke, and formation of hard carbon deposits when used at high temperatures. While ester fluids generally perform well at high temperatures, certain types of ester fluids, such as complex esters, have a tendency to polymerize at high temperatures, resulting in the formation of hard deposits that do not readily evaporate. As a result, complex esters are generally not useful in lubricant compositions for use at high temperatures where low deposit formation is desired. As such, it is desirable to further improve upon the performance of ester base oils to effectively lubricate equipment that operates under extreme and demanding conditions.

In some applications, such as lubricating a conveyor chain driven by a motor, a thin film of lubricant is applied to the conveyor chain at a regular lubrication interval of roughly four to eight hours. However, conventional high temperature lubricants may evaporate relatively quickly, resulting in a shorter lubrication interval. Furthermore, conventional high temperature lubricants have a tendency to polymerize and form hard deposits that must be manually removed, by scraping or otherwise. The hard deposits inhibit movement of the lubricated parts causing premature wear, sticking, and breakage. As the lubricant evaporates and forms deposits, the motor used to drive the conveyor chain must work harder and use more energy. This results in more frequent maintenance of the apparatus, and requires that the conveyor chain be manually cleaned via scraping or the like.

Thus, there exists a need in the art for a high temperature lubricant that has low evaporation to allow for a longer lubrication interval and low deposit formation. More specifically, there exists a need in the art for a lubricant composition that may be used in high temperature application that forms only soft deposits, if any, so as to minimize the need for cleaning and maintenance of the lubricated apparatus.

BRIEF SUMMARY OF THE INVENTION

The present invention relates to a lubricant composition for use in high temperature applications. The present invention provides a lubricant composition that exhibits low evaporation and low deposit formation relative to conventional high-temperature lubricants, such that the lubricant provides effective lubrication for a longer period of time to reduce the interval at which the lubricant must be reapplied to an apparatus. Less frequent lubrication results in cost benefits due to the use of less lubricant overall, and low deposit formation allows for less frequent need for cleaning and maintenance of the equipment/apparatus.

In one embodiment, the high-temperature lubricant composition includes a base oil, wherein the base oil is a mixture of one or more polyol esters and one or more pyromellitate esters, and wherein when the lubricant composition is used at temperatures of 240° C. or greater in air, the bulk lubricant composition exhibits operational lubrication for at least 44 hours. As used herein, "operational lubrication" means a condition in which the lubricant provides suitable lubrication for proper operation of a lubricated apparatus, which can be considered to exist when the lubricant composition retains a liquid fraction of at least 50 percent of the total weight of the lubricant as originally applied and/or when the total deposit formation as measured by a pan test is equal to or less than 2.75.

In some embodiments, the polyol ester is a pentaerythritol ester or a dipentaerythritol ester. Other suitable polyol esters for use with the present invention include trimethylol propane esters and complex polyol esters, among others. In one embodiment, the dipentaerythritol ester has a structure according to formula (I):

(I)

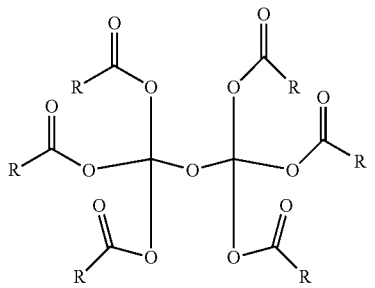

wherein each R group is a linear or branched, saturated alkyl group having between about 4 and about 10 carbon atoms, wherein each R group can be the same or different. The polyol ester may be a dipentaerythritol ester wherein the R groups include a mixture of linear and branched chains derived from linear and branched chain acids. In one embodiment, the polyol ester is primarily dipentaerythritol hexa-isononanoate.

Pyromellitate esters include those esters formed from pyromellitic acid or pyromellitic dianhydride. In one embodiment, the pyromellitate esters are formed using branched alcohols having between about 3 and about 15 carbon atoms. For example, in one embodiment, the pyromellitate ester is formed using isodecyl alcohol and/or tridecyl alcohol. In a preferred embodiment, the pyromellitate ester is tetra 2-ethyl-hexyl pyromellitate.

The pyromellitate is preferably 1 percent to 99 percent by weight of the lubricant composition. The relative amounts of the pyromellitate ester and the polyol ester can be adjusted in order to achieve a lubricant composition having a desired viscosity. Preferably, the lubricant composition has a kinematic viscosity at 40° C. of about 90 to about 250 centistokes. However, a person having ordinary skill in the art will appreciate that the kinematic viscosity will vary depending upon the specific components and additives of the lubricant composition.

In some embodiments, the lubricant composition further includes one or more antioxidants, or a mixture of antioxidants. The antioxidants may be one or more diphenylamines, naphthyl phenyl amines, phenols, thiophenols, carbamates, and/or phosphites, wherein the antioxidants are preferably primary or secondary antioxidants. However, in some embodiments tertiary antioxidants may be used. The total weight of the one or more antioxidants is preferably between about 0.5 percent to about 5.0 percent by weight of the total lubricant composition. More preferably, the total weight of the one or more antioxidants is between about 2.0 percent and about 4.0 percent by weight of the total lubricant composition.

In other embodiments, the lubricant composition further includes one or more extreme pressure additives and/or one or more anti-wear additives.

The present invention further relates to a method for lubricating an apparatus operated at high temperatures, including applying to a surface of the apparatus the lubricant composition as described above. In another embodiment, the present invention relates to a method for producing a lubricant composition for high temperature applications, including combining at least one pyromellitate ester and at least one polyol ester in solution, such that when the lubricant composition is in use at a temperature at or above 240° C., operational lubrication is maintained for at least 44 hours as measured by a pan test. Alternately, or additionally, the method produces a lubricant composition that in use at temperatures at or above 240° C. for at least 44 hours has total deposit formation of less than 2.75 as determined by a pan test. The method may also include the step of adding one or more additives to the solution, wherein the one or more additives are selected from the group of an extreme pressure additive, an anti-wear additive, and an antioxidant.

In yet another embodiment, the present invention relates to a method for improving the operational lubrication of a conventional high temperature lubricant containing a polyol ester, including adding a pyromellitate ester to the conventional high temperature lubricant such that the pyromellitate ester is at least 15 percent by weight of the total weight of the high temperature lubricant, wherein when the high temperature lubricant is used at a temperature of 240° C. or greater, operational lubrication is maintained for at least 44 hours.

In another embodiment, the present invention relates to a method of maintaining operational lubrication of an apparatus operated at a high temperature including applying to a surface of the apparatus the lubricant composition as described above. The method may further include the step of reapplying the lubricant composition a specified interval, such as every 4 to 8 hours.

The present invention is also directed to a lubricant composition, including a base oil including a mixture of at least one polyol ester and at least one pyromellitate ester, wherein, after at least 44 hours at a temperature of 240° C., the lubricant composition has a liquid fraction of at least about 50 percent. In one embodiment, the lubricant composition has evaporation of about 15 percent or less after at least 44 hours at a temperature of 240° C. In another embodiment, the at least one polyol ester comprises a pentaerythritol ester, a dipentaerythritol ester, or a mixture thereof. In yet another embodiment, the at least one polyol ester comprises a dipentaerythritol ester having a structure according to the following formula:

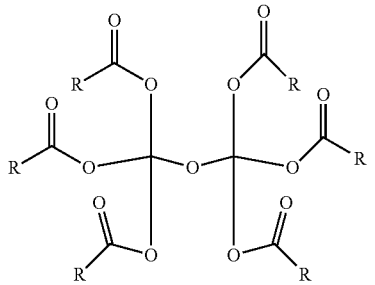

wherein each R group is a linear or branched, saturated alkyl group having between about 4 and about 10 carbon atoms. The at least one R group may be a linear, saturated alkyl group, and wherein at least one R group is a branched, saturated alkyl group.

In one embodiment, the pyromellitate ester has a structure according to the following formula:

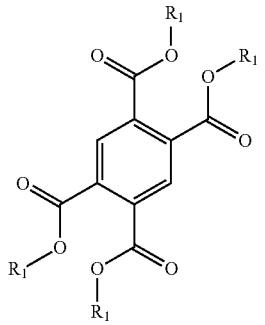

wherein $R_1$ is a branched or unbranched, saturated alkyl group having about 3 to about 15 carbon atoms. In another embodiment, the pyromellitate ester may be selected from the group consisting of tetraisopropyl pyromellitate, tetra 2-ethylhexyl pyromellitate, tetraheptyl pyromellitate, tetraoctyl pyromellitate, tetranonyl pyromellitate, tetradecyl pyromellitate, tetraisodecyl pyromellitate, tetra isononyl pyromellitate, tetra isooctyl pyromellitate, tetrabutyl pyromellitate, tetra isobutyl pyromellitate, and combinations thereof. In yet another embodiment, the pyromellitate ester is present in an amount of about 40 percent to about 70 percent by weight of the lubricant composition. The lubricant composition may have a kinematic viscosity at about 40° C. of about 90 to about 250 centistokes. In addition, the lubricant may include at least one antioxidant. Moreover, the lubricant composition may further include at least one additive selected from the group consisting of an extreme pressure additive, an anti-wear additive, an anti-rust additive, and a corrosion inhibitor.

The present invention also relates to a lubricant composition, including a base oil including at least one polyol ester having a structure according to the following formula (I):

(I)

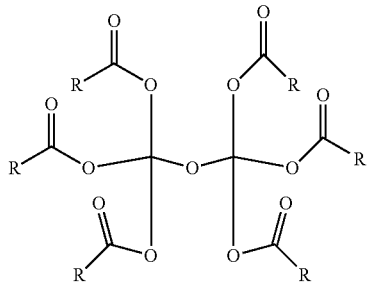

wherein each R group is a linear or branched, saturated alkyl group having between about 4 and about 10 carbon atoms, and at least one pyromellitate ester having a structure according to the following formula:

(II)

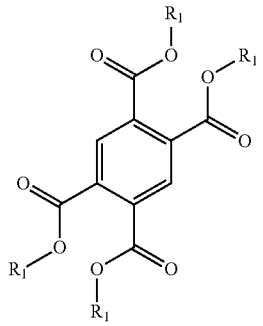

wherein $R_1$ is a branched or unbranched, saturated alkyl group having about 3 to about 15 carbon atoms, wherein the lubricant composition has a kinematic viscosity at about 40° C. of about 198 to about 242 centistokes. In this aspect, $R_1$ may have about 3 to about 13 carbon atoms. In one embodiment, the lubricant composition has a liquid fraction of at least about 50 percent after at least 44 hours at a temperature of 240° C. In addition, the lubricant composition may have evaporation of about 15 percent or less after at least 44 hours at a temperature of 240° C. In another embodiment, the at least one pyromellitate ester is present in an amount of about 40 percent to about 70 percent by weight of the composition. In yet another embodiment, the at least one pyromellitate ester is present in an amount of about 10 percent to about 40 percent by weight of the composition.

The present invention is also directed to a lubricant composition, including a base oil including at least one polyol ester including a pentaerythritol ester, a dipentaerythritol ester, or a mixture thereof; and at least one pyromellitate ester having a structure according to the following formula:

(II)

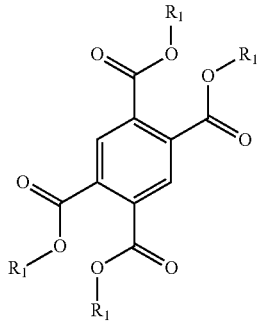

wherein $R_1$ is a branched or unbranched, saturated alkyl group having about 3 to about 15 carbon atoms, wherein the lubricant composition has a kinematic viscosity at about 40° C. of about 90 to about 250 centistokes, and wherein, after at least 44 hours at a temperature of 240° C., the lubricant composition has a liquid fraction of at least about 50 percent and evaporation of about 15 percent or less. In one embodiment, the at least one pyromellitate ester comprises tetra 2-ethylhexyl pyromellitate. In another embodiment, the at least one pyromellitate ester comprises tetraisopropyl pyromellitate, tetraheptyl pyromellitate, tetraoctyl pyromellitate, tetranonyl pyromellitate, tetradecyl pyromellitate, tetraisodecyl pyromellitate, tetra isononyl pyromellitate, tetra isooctyl pyromellitate, tetrabutyl pyromellitate, tetra isobutyl pyromellitate, or combinations thereof.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

Figure 1:
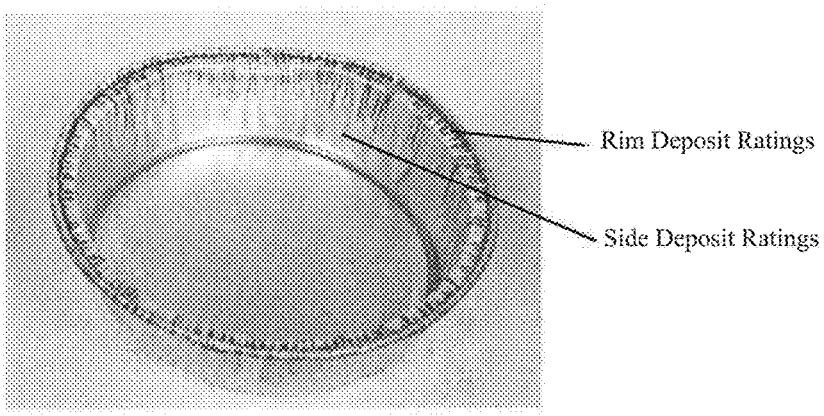
FIG. 1 shows an example of a pan to show the areas where rim deposits and side deposits are measured during a pan test.

The present invention provides a high temperature lubricant composition having low evaporation and low deposit formation when used in high temperature applications compared to conventional high temperature lubricants. By "high temperature" lubricant, it is meant bulk compositions that can be exposed to temperatures of about 200° C. to about 300° C. for 20-92 hours in air without undergoing substantial degradation, such as oxidative breakdown, thermal breakdown, and/or polymerization. Through repeated use, the high temperature lubricant compositions of the present invention should also exhibit minimal formation of hard deposits over extended periods of months or years.

Without being bound to any particular theory, as a lubricant composition is used in high temperature application, a portion of the lubricant composition is lost to evaporation. In addition, a portion of the lubricant may form a residue or deposit. The portion of the lubricant composition that is not evaporated and that does not contribute to residue or deposit formation is the liquid fraction, wherein the liquid fraction is responsible for maintaining lubrication of a surface. As the liquid fraction decreases, the lubricated surface may no longer be properly lubricated, giving rise to increased frictional resistance and wear, inhibiting operation of the apparatus and potentially resulting in damage to the lubricated surface and other components of the apparatus.

In one embodiment, when the lubricant composition of the invention is used at temperature at or above 240° C. in air, the liquid fraction of the lubricant composition is at least 50 percent by weight of the total weight of the lubricant composition as originally applied for at least 44 hours in air (as determined by a pan test). In another embodiment, the liquid fraction of the lubricant composition of the invention is at least 50 percent by weight of the total weight of the lubricant composition as originally applied for at least 68 hours in air (as determined by a pan test). In yet another embodiment, when the lubricant composition of the invention is used at a temperature at or above 240° C. in air for at least 44 hours, the total deposit formation is 2.75 or less as measured by a pan test. In still another embodiment, when the lubricant composition of the invention is used at a temperature at or above 240° C. in air for at least 68 hours, the total deposit formation is 2.75 or less as measured by a pan test.

Compositions

The lubricant composition of the present invention includes a base oil that is a mixture of one or more polyol esters and one or more pyromellitate esters. The base oil components and other additives suitable for use with the present invention are described in detail below.

Polyol Esters

The one or more polyol esters in the base oil of the lubricant composition may include: pentaerythritol esters, dipentaerythritol esters, and combinations thereof, among others. In one embodiment, the polyol ester is a dipentaerythritol ester having a structure according to formula (I):

(I)

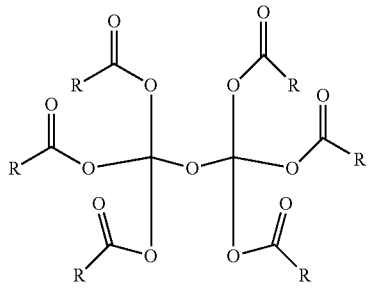

where R is a branched or linear, saturated alkyl group having about 4 to about 10 carbon atoms. The R groups may be the same or different from one another. In a preferred embodiment, the polyol ester is dipentaerythritol hexa-isononanoate. In another embodiment, the polyol ester is a dipentaerythritol ester according to formula (I) wherein the R groups include a mixture of branched and linear, saturated alkyl groups.

The polyol ester component may be present in the lubricant composition in an amount of about 10 percent to about 90 percent by weight of the lubricant composition. In one embodiment, the polyol ester component is present in an amount of about 50 percent to about 85 percent by weight of the lubricant composition. In another embodiment, the lubricant composition includes about 10 percent to about 40 percent by weight of the polyol ester component. In yet another embodiment, the polyol ester component may be included in an amount of about 20 percent to about 60 percent by weight of the lubricant composition. In still another embodiment, the polyol ester component is present in an amount of about 60 percent to about 75 percent by weight of the lubricant composition.

Pyromellitate Esters

Conventional lubricant compositions for high temperature applications generally include a polyol ester and a complex ester or other blendstock that have a polyhydroxy in the middle. Without being bound to any particular theory, it is now believed that the use of a pyromellitate ester in a mixture with one or more polyol esters avoids the formation of varnishes/hard deposits after application of high temperature that occurs in conventional lubricant compositions, e.g., compositions including polyol esters and complex esters, because the pyromellitate ester has a central polyacid rather than a central polyhydroxy. In other words, the pyromellitate is a polyacid-mono alcohol ester whereas conventional lubricant compositions typically include a monoacid-polyalcohol structure. The central polyacid reduces the formation of polymers as acids are generated by oxidation, which is generally the cause of the varnish/hard deposits in conventional lubricant compositions where there is a central polyhydroxy.

One or more pyromellitate esters may be used in the lubricant composition of the invention. Suitable non-limiting examples include esters formed from pyromellitic acid or pyromellitic anhydride. In one embodiment, the pyromellitate ester has the structure according to formula (II):

(II)

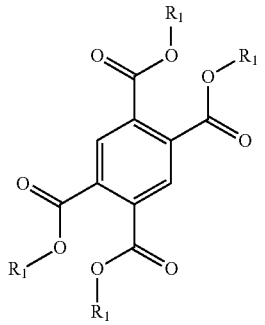

wherein $R_1$ is a branched or unbranched, saturated alkyl group having about 3 to about 15 carbon atoms. In one embodiment, $R_1$ has about 3 to about 13 carbon atoms. In another embodiment, $R_1$ has about 8 to about 13 carbon atoms. In yet another embodiment, $R_1$ has about 10 to about 13 carbon atoms. The $R_1$ groups can be the same or different from one another. In one embodiment, the $R_1$ groups are the same. In another embodiment, the pyromellitate ester is tetra 2-ethylhexyl pyromellitate. In yet another embodiment, the pyromellitate ester is at least one of tetraisopropyl pyromellitate, tetraheptyl pyromellitate, tetraoctyl pyromellitate, tetranonyl pyromellitate, tetradecyl pyromellitate, tetraisodecyl pyromellitate, tetraisononyl pyromellitate, tetraisooctyl pyromellitate, tetrabutyl pyromellitate, tetraisobutyl pyromellitate, or combinations thereof. For example, in one embodiment, the pyromellitate ester is selected from at least one of tetraheptyl pyromellitate, tetraoctyl pyromellitate, tetranonyl pyromellitate, tetradecyl pyromellitate, tetrabutyl pyromellitate, or combinations thereof. In yet another embodiment, the pyromellitate ester is selected from at least one of tetraisopropyl pyromellitate, tetraisodecyl pyromellitate, tetraisononyl pyromellitate, tetraisooctyl pyromellitate, tetraisobutyl pyromellitate, or combinations thereof. In still another embodiment, the pyromellitate ester is isodecyl pyromellitate.

When more than one pyromellitate ester is used, the pyromellitate esters may include mixtures of any of the above pyromellitate esters. For example, the base oil may include a first pyromellitate ester including tetra 2-ethylhexyl pyromellitate and a second pyromellitate ester according to Formula II. In one embodiment, the base oil may include at least one pyromellitate ester including tetra 2-ethylhexyl pyromellitate and at least one pyromellitate ester selected from the group consisting of tetraisopropyl pyromellitate, tetraheptyl pyromellitate, tetraoctyl pyromellitate, tetranonyl pyromellitate, and combinations thereof. In another embodiment, the first pyromellitate ester may be a pyromellitate ester according to Formula II where the $R_1$ groups are same and the second pyromellitate ester may be a pyromellitate ester according to Formula II where the $R_1$ groups are different from one another.

The pyromellitate ester may be present in the lubricant composition in an amount of about 1 percent to about 99 percent by weight of the lubricant composition. In one embodiment, the pyromellitate ester is present in an amount of about 10 percent to about 90 percent by weight of the lubricant composition. In another embodiment, the lubricant composition includes about 10 percent to about 40 percent by weight of a pyromellitate ester or mixture of pyromellitate esters. In yet another embodiment, the pyromellitate ester may be included in an amount of about 40 percent to about 70 percent by weight of the lubricant composition. In still another embodiment, the pyromellitate ester is present in an amount of about 50 percent to about 65 percent by weight of the lubricant composition.

However, the relative amounts of polyol ester and pyromellitate ester can be adjusted to provide a lubricant composition having a desired kinematic viscosity. In particular, the kinematic viscosity of the composition will vary, as is understood by a person of skill in the art, depending upon the specific components and the relative amounts used in the composition. However, it is preferable that the composition has a kinematic viscosity at 40° C. of about 90 to about 250 centistokes. In one embodiment, the lubricant composition has a kinematic viscosity at 40° C. of about 150 to about 250 centistokes. In another embodiment, the lubricant composition has a kinematic viscosity at 40° C. of about 198 to about 242 centistokes. In yet another embodiment, the lubricant composition has a kinematic viscosity at 40° C. of about 200 to about 220 centistokes. Further, the flash point of the composition is preferably 250° C. or greater.

Additives

In some embodiments, the lubricant composition further includes one or more antioxidants, or a mixture of antioxidants. Suitable non-limiting antioxidants for use in the lubricant composition include one or more diphenylamines, naphthyl phenyl amines, phenols, thiophenols, thiocarbamates, triazoles, tocopherols, phosphites, or any combination thereof. In particular, any of various antioxidants may be used, depending upon the embodiment, including, but not limited to, phenyl-1-naphthylamine, phenyl-2-naphthylamine, diphenyl-p-phenylenediamine, dipyridylamine, octylated diphenylamine, butylated diphenylamine, 1-naphthalenamine, N-(dodecylphenyl), phenothiazine, N-methylphenothiazine, N-ethylphenothiazine, 3,7-dioctylphenothiazine, P,P'-dioctyldiphenylamine, N,N'-diisopropyl-p-phenylenediamine, N,N'-di-sec-butyl-p-phenylenediamine, 2,6-di-tert-dibutylphenol, 2,4,6-tri-t-butylphenol, 2-t-butylphenol, 4-methyl-2,6-di-t-butylphenol, 2-methyl-6-t-butylphenol, 2,4-dimethyl-6-t-butylphenol, polymeric trimethyl-dihydroquinoline, benzenamine, N-phenyl-, reaction product with 2,4,4-trimethylpentene (p,p'-dioctlydiphenylamine), carbamodithioic acid, dibutyl-methylene ester, pentaerythritol tetrakis(3-(3,5-di-tert-butyl-4-hydroxyphenyl)propionate), 3,4-dihydro-2,5,7,8-tetramethyl-2-(4,8,12-trimethyltridecyl)-2H-1-benzopyran-6-ol, thiodiethylene bis [3-(3,5-di-tert-butyl-4-hydroxyphenyl)propionate, methylene bis-(dibutyldithiocarbamate), tolutriazole derivatives, and blends thereof, among others. In one embodiment, the antioxidants are primary antioxidants. In another embodiment, the antioxidants are secondary antioxidants. In yet another embodiment, the antioxidants are tertiary antioxidants.

Commercially available antioxidants include IRGANOX® L-64, IRGANOX® 101, IRGANOX® L-115, IRGANOX® L-57, IRGANOX® L-06, VANLUBE® 961, VANLUBE® 1202, VANLUBE® 81, VANLUBE® 996E, VANLUBE® 9317, VANLUBE® 915M, VANLUBE® 887E, VANLUBE® 407, VANLUBE® 7723, Functional Products Antioxidant A0-510, Functional Products Antioxidant A0-520, Additin® RC 7001, Additin® RC 7010, Additin® RC 7110, Additin® RC 7115, Additin® RC 7120, Additin® RC 7130, Additin® RC 7132, Additin® 7135, DorfKetal Antioxidant PX 3811, and chemical or functional equivalents thereof.

When used, the antioxidant(s) is (are) present in the composition in an amount of about 0.5 percent to about 5 percent by weight of the lubricant composition. In one embodiment, the antioxidant(s) is (are) present in the lubricant composition is an amount of about 2.0 percent to about 4.0 percent by weight of the lubricant composition. In another embodiment, the antioxidant(s) is (are) present in the lubricant composition in an amount of about 1 percent to about 3 percent by weight of the lubricant composition. In yet another embodiment, the lubricant composition includes about 3 percent to about 5 percent antioxidants by weight of the lubricant composition. For example, in one embodiment, the lubricant composition includes at least two antioxidants, each present in an amount of about 0.5 percent to about 2 percent by weight of the lubricant composition. In another embodiment, the lubricant composition includes at least three antioxidants, where each antioxidant is present in an amount of about 0.5 percent to about 2 percent by weight of the lubricant composition.

In other embodiments, the lubricant composition further includes one or more functional additives including extreme pressure additives, anti-wear additives, anti-rust additives, corrosion inhibitor additives, or combinations thereof. Often, these additives are multi-functional and include but are not limited to triaryl phosphorothionates, carbamates, sulfurized compounds, inorganic nanoparticles, lignins, borate esters, fullerenes, dialkyl phosphites, and amine phosphate mixtures. Commercially available additives include VANLUBE® EZ, VANLUBE® 7723, VANLUBE® 73 Super Plus, VANLUBE® SB, VANLUBE® 289, IRGALUBE® TPPT and IRGALUBE® 349, DESILUBE AEP, DESILUBE 77, DESILUBE 88, NANOLUB®, DOVERPHOS® 253, benzotriazole, DOVERLUBE NCEP, ELCO 2020, ELCO 670, NA-LUBE 5415 and NA-LUBE 5425, among others. Each of these functional additives, i.e., extreme pressure additives, anti-wear additives, anti-rust additives, corrosion inhibitor additives, multi-functional additives, may be independently or collectively present in the lubricant composition in an amount of about 0.01 percent to 1.00 percent by weight of the lubricant composition. For example, if included, the lubricant composition may include about 0.5 weight percent of a first functional additive and about 0.5 weight percent of a second functional additive. In one embodiment, at least three functional additives are employed, each in an amount of about 0.1 percent to about 0.5 percent by weight of the lubricant composition.

Method of Preparing Composition

The lubricant composition of the present invention can be produced by combining at least one pyromellitate ester and at least one polyol ester in solution. Preferably, the at least one pyromellitate and at least one polyol ester are heated with agitation to a temperature of 60° C. or greater to promote dissolution. The method may also include adding one or more additives to the solution, wherein the one or more additives include antioxidants and functional additives as discussed above.

In another embodiment, the operational lubrication of a conventional high temperature lubricant including a polyol ester can be improved by addition of at least one pyromellitate ester to a conventional high temperature lubricant composition that includes a polyol ester. A pyromellitate ester can be added to and combined with the conventional high temperature lubricant that includes a polyol ester such that the pyromellitate ester is at least 15 percent by weight of the total weight of the resultant lubricant composition. In one embodiment, the pyromellitate ester is added to the conventional high temperature lubricant composition including a polyol ester such that the pyromellitate ester is at least 20 percent by weight of the total weight of the resultant lubricant composition. When the high temperature lubricant with the pyromellitate ester is used at a temperature of 240° C. or greater, bulk operational lubrication is maintained for at least 44 hours as determined by a pan test in air.

Method of Lubricating Apparatus

The present invention further relates to a method for lubricating an apparatus operated at high temperatures, including applying to a surface of the apparatus the lubricant composition as described above. In some embodiments, the apparatus is a conveyor chain driven by a motor. The method may further include the step of reapplying the lubricant at a fixed lubrication interval, such as every 4 to 8 hours, every 8 to 12 hours, or one to three times per operating day, wherein an operating day defines the number of hours a piece of equipment operates during a 24 hour period, wherein an operating day is preferably about 8 hours to about 24 hours.

Operational lubrication, as discussed above, is used to denote a condition wherein the surface of an apparatus is sufficiently lubricated to carry out the intended activity or operation. Operational lubrication exists when the liquid fraction of the bulk lubricant is at least 50 percent of the original total weight of the lubricant composition as originally applied as measured by a pan test in air. In one embodiment, the liquid fraction of the lubricant composition of the invention is at least about 50 percent by weight of the total weight of the lubricant composition as originally applied for at least 44 hours at 240° C. and at least about 35 percent after at least 68 hours at 240° C. (as determined by a pan test). Preferably, the liquid fraction of the lubricant composition of the invention is at least about 50 percent by weight of the total weight of the lubricant composition as originally applied for at least 44 hours at 240° C., more preferably at least 68 hours at 240° C. (as determined by a pan test). In one embodiment, the liquid fraction of the lubricant composition of the invention is at least about 55 percent by weight of the total weight of the lubricant composition as originally applied for at least 44 hours at 240° C., more preferably at least 68 hours at 240° C. (as determined by a pan test). In another embodiment, the liquid fraction of the lubricant composition of the invention is at least about 60 percent by weight of the total weight of the lubricant composition as originally applied for at least 44 hours at 240° C. (as determined by a pan test). In still another embodiment, the liquid fraction of the lubricant composition of the invention is at least about 70 percent by weight of the total weight of the lubricant composition as originally applied for at least 44 hours at 240° C. (as determined by a pan test). For example, the lubricant composition of the present invention may have a liquid fraction after at least 44 hours at 240° C. that ranges from about 70 percent to about 75 percent by weight of the total weight of the lubricant composition as originally applied. In yet another embodiment, the liquid fraction of the lubricant composition of the invention is at least about 10 percent by weight of the total weight of the lubricant composition as originally applied for at least 92 hours at 240° C. (as determined by a pan test).

In yet another embodiment, the liquid fraction of the lubricant composition of the invention is at least about 60 percent by weight of the total weight of the lubricant composition as originally applied for at least 20 hours at 260° C. (as determined by a pan test). In still another embodiment, the liquid fraction of the lubricant composition of the invention is at least about 70 percent by weight of the total weight of the lubricant composition as originally applied for at least 20 hours at 260° C. (as determined by a pan test).

Alternatively, or additionally, operational lubrication exists when the total deposit formation is less than about 2.75 after at least 44 hours at 240° C., preferably after at least 68 hours, as determined by a pan test. In one embodiment, the total deposit formation is about 2 to about 2.75 after at least about 44 hours at 240° C., preferably after at least 68 hours.

The evaporation and residue of the lubricant composition after about 44 hours at 240° C. is about 15 percent or less and less than 15 percent, respectively. For example, the evaporation of the lubricant composition after about 44 hours at 240° C. may be between about 5 percent and 15 percent. In one embodiment, the evaporation of the lubricant composition after about 44 hours at 240° C. is about 8 percent to about 13 percent. In another embodiment, the evaporation of the lubricant composition after about 44 hours at 240° C. is about 10 percent to about 15 percent. In yet another embodiment, the evaporation of the lubricant composition after about 44 hours at 240° C. is about 13 percent to about 15 percent. The residue after about 44 hours at 240° C. may be between about 5 percent and 14 percent. In one embodiment, the residue of the lubricant composition after about 44 hours at 240° C. is about 8 percent to about 12 percent. In another embodiment, the residue of the lubricant composition after about 44 hours at 240° C. is about 10 percent to about 12 percent.

The evaporation and residue of the lubricant composition after about 68 hours at 240° C. is less than about 30 percent in both cases. For example, the evaporation of the lubricant composition after about 68 hours at 240° C. may be between about 20 percent and 29 percent. In one embodiment, the evaporation of the lubricant composition after about 44 hours at 240° C. is about 25 percent to about 29 percent. The residue after about 68 hours at 240° C. may be between about 15 percent and 29 percent. In one embodiment, the residue of the lubricant composition after about 44 hours at 240° C. is about 20 percent to about 29 percent.

The evaporation and residue of the lubricant composition after about 92 hours at 240° C. is less than about 45 percent and less than about 60 percent, respectively. For example, the evaporation of the lubricant composition after about 92 hours at 240° C. may be between about 30 percent and 44 percent. In one embodiment, the evaporation of the lubricant composition after about 92 hours at 240° C. is about 35 percent to about 42 percent. The residue after about 92 hours at 240° C. may be between about 40 percent and 59 percent. In one embodiment, the residue of the lubricant composition after about 92 hours at 240° C. is about 40 percent to about 57 percent. The evaporation and residue of the lubricant composition after about 20 hours at 260° C. is less than about 20 percent in both cases.

Each of the liquid fraction, evaporation, residue, and total deposits discussed above can be independently met in the lubricant compositions of the invention. However, it is also contemplated that more than one of these properties, i.e., liquid fraction, evaporation, residue, and total deposits, are met in the lubricant compositions of the invention. Indeed, it is desirable to have high liquid fraction in combination with low evaporation, low residue, and/or low total deposits. For example, in one embodiment, after at least 44 hours at 240° C., the lubricant composition of the invention has (1) a liquid fraction that is at least about 50 percent by weight of the total weight of the lubricant composition as originally applied and (2) evaporation of about 15 percent or less. In another embodiment, after at least 44 hours at 240° C., the lubricant composition of the invention has (1) a liquid fraction that is about 50 percent to about 75 percent by weight of the total weight of the lubricant composition as originally applied and (2) evaporation of about 10 percent to about 15 percent.

In yet another embodiment, after about 68 hours at 240° C., the lubricant composition of the invention has (1) a liquid fraction that is at least about 40 percent by weight of the total weight of the lubricant composition as originally applied and (2) evaporation of about 30 percent or less. For example, after at least 68 hours at 240° C., the lubricant composition of the invention may have (1) a liquid fraction that is about 40 percent to about 55 percent by weight of the total weight of the lubricant composition as originally applied and (2) evaporation of about 20 percent to about 29 percent.

In still another embodiment, after about 44 hours at 240° C., the lubricant composition of the invention has (1) a residue of about 5 percent and 14 percent and at least one of (a) a liquid fraction that is at least about 50 percent by weight of the total weight of the lubricant composition as originally applied and (b) evaporation of about 15 percent or less. For example, after at least 44 hours at 240° C., the lubricant composition of the invention may have (1) a residue of about 8 percent and 12 percent and at least one of (a) a liquid fraction that is about 50 percent to about 75 percent by weight of the total weight of the lubricant composition as originally applied and (b) evaporation of about 10 percent to about 15 percent.

In yet another embodiment, after about 68 hours at 240° C., the lubricant composition of the invention has (1) a residue of about 15 percent and 29 percent and at least one of (a) a liquid fraction that is at least about 40 percent by weight of the total weight of the lubricant composition as originally applied and (b) evaporation of about 30 percent or less. For example, after at least 68 hours at 240° C., the lubricant composition of the invention may have (1) a residue of about 20 percent and 29 percent and at least one of (a) a liquid fraction that is about 40 percent to about 55 percent by weight of the total weight of the lubricant composition as originally applied and (b) evaporation of about 20 percent to about 29 percent.

EXAMPLES

The following non-limiting examples are merely illustrative of preferred embodiments of the present invention, and are not to be construed as limiting the invention, the scope of which is defined by the appended claims.

Example 1: Identifying an Improved High Temperature Lubricant

It is difficult to know or predict the performance of a lubricant having a given composition without actually testing the lubricant composition. Further, lubricant compositions can be formed from a nearly infinite combination of base oils and additives, such as antioxidants, anti-wear additives, and extreme pressure additives, among others. In order to identify a high temperature lubricant composition with improved performance demonstrating low deposit formation and low evaporation, a wide variety of samples were created for testing in an attempt to determine trends that may help to identify a composition with improved performance. The samples prepared had various combinations of base oils, such as various alkylated naphthalenes, various polyol esters, various complex esters, various trimellitate esters, various pyromellitate esters, and combinations thereof having different relative amounts of each base oil. The samples further differed in the amount and type of additive or additives included in the samples. The prepared samples were tested using the pan test method wherein performance was compared to that of commercially available high temperature lubricant compositions known to perform well at high temperatures. Analysis of the samples revealed a surprising and unexpected trend wherein those lubricant compositions including a polyol ester and a pyromellitate ester demonstrated low evaporation and low deposit formation relative to the other samples and relative to the commercially available lubricant compositions known to perform well at high temperature. This led to the hypothesis that polyol ester pyromellitate lubricants have unique high temperature performance. Such samples were further evaluated using additional pan tests and were further subject to varnish panel testing and thermogravimetric analysis. The additional examples demonstrate the validity of the hypothesis.

Example 2: Sample High Temperature Lubricant Compositions

In Table 1, each column represents a sample high temperature lubricant composition, wherein the column lists the percentage amount of each component in the sample. PMI, PM2, PM4, and PM5 are samples having a composition according to the present invention ("inventive compositions"), and include a pyromellitate ester, a polyol ester, and one or more additives. RD1, RD2, and RD3 are conventional high temperature lubricant samples ("comparative compositions") that do not include a pyromellitate ester and instead comprise a polyol ester and a complex ester or other blendstock. Com1, Com2, and Com3 are commercially available high temperature lubricant compositions known to have good high temperature performance which are used as standards for comparison against the samples. Com1 includes a polyol ester and a complex ester with additives, Com2 includes a mixture of polyol esters with additives, and Com3 includes a polyol ester with additives. The additive blend is different for each of the Com standards, wherein the additive blend denotes a mixture of one or more of various antioxidants, anti-wear, anti-rust, and extreme pressure additives. The precise composition of each Com standard is proprietary.

TABLE 1

| Lubricant Compositions | | | | | | | | | | |
|---|---|---|---|---|---|---|---|---|---|---|
| Composition | PM1 | PM2 | PM4 | PM5 | RD1 | RD2 | RD3 | COM1 | COM2 | COM3 |
| Additives | | | | | | | | | | |
| Irgalube TPPT | — | 0.2% | 0.2% | 0.1% | — | — | 0.2% | — | — | — |
| Irgalube 349 | 0.1% | 0.1% | 0.1% | 0.1% | 0.1% | 0.1% | 0.1% | — | — | — |
| Benzotriazole | 0.1% | 0.1% | 0.1% | 0.1% | 0.1% | 0.1% | 0.1% | — | — | — |
| Irganox L-06 | 1.5% | 1.5% | 1.5% | 1.5 | 1.5% | 1.5% | 1.5% | — | — | — |
| Vanlube 81 | 1.5% | 1.5% | 1.5% | 1.5% | 1.5% | 1.5% | 1.5% | — | — | — |
| Vanlube 9317 | 1.0% | — | — | 0.5% | — | — | — | — | — | — |
| Vanlube 7723 | — | — | — | — | — | 0.5% | — | — | — | — |
| Additive Blend | — | — | — | — | — | — | — | 3.4% | 3.4% | 3.2% |
| Base Blends | | | | | | | | | | |
| Polyol Esters | | | | | | | | | | |
| Lexolube 4N-415 | — | — | — | — | — | 33.2% | — | 13.0% | — | — |
| Lexolube 3S-310 | — | — | — | — | 14.5% | 14.9% | 15.0% | 15.0% | 14.5% | — |
| PQ-68 | — | 18.3% | — | 9.0% | 75.0% | — | 47.1% | — | — | — |
| Lexolube POE-50HT | 36.6% | 63.3% | 32.8% | 48.1% | — | — | — | — | 38.6% | — |
| Lexolube 4VQ-415 | — | — | — | — | — | — | — | — | 43.5% | — |
| Lexolube POE-20HT | — | — | — | — | — | — | — | — | — | 96.8% |
| Pyromellitate Esters | | | | | | | | | | |
| Lexolube 4PM-114 | 63.2% | 15.0% | 63.8% | 38.1% | — | — | — | — | — | — |
| Complex Esters | | | | | | | | | | |
| Lexolube CPE-1000 | — | — | — | — | — | 48.2% | 34.5% | — | — | — |
| Lexolube CPE-220 | — | — | — | — | — | — | — | 68.6% | — | — |
| Docadit HV HG | — | — | — | — | 7.3% | — | — | — | — | — |

Example 3: Pan Testing of High Temperature Lubricant Samples

The samples were tested via a Pan Test Method designed to model thin film and bulk lubrication properties in air at high temperatures, similar to those that would be experienced by an oven chain lubricant. The pan test was performed according to the general following procedure:

Equipment:

High temperature Blue M/Lindberg oven with two shelves (outside dimensions 36×22")

Aluminum sample pans with 43 mm base and 13 mm deep

Steel bottom sheet 11×17×1 inches with orientation and sample positions labeled (×2)

Cover sheet 9×9×2 inches with four ½ inch by 3½ inch vents on top (×2)

Procedure:

Weigh 2 grams +/−0.01 grams of lubricant into each sample pan

Thirty-two total samples per test representing 4 samples each of 8 different lubricants Immediately after weighing, place samples in designated position on bottom sheet When all sixteen samples are weighed, make sure pans form a square and touch at the edges Cover samples and place on proper shelf in oven After the end of the test, cool for 30 minutes minimum Visually determine deposits on the top rim and side edge of sample pan and rank on a 0-5 scale 0=no deposit 5=very heavy deposit Weigh Each Pan After weighing, clamp each pan on the edge using a ¾ inch clamp Suspend pans vertically for 10 minutes so the liquid can drain out Reweigh pans after draining Measurements:

Visual record of varnish and deposits

Weight loss by evaporation

Liquid fraction that freely drains from the pan

Residue left in pan after draining

Figure 2:
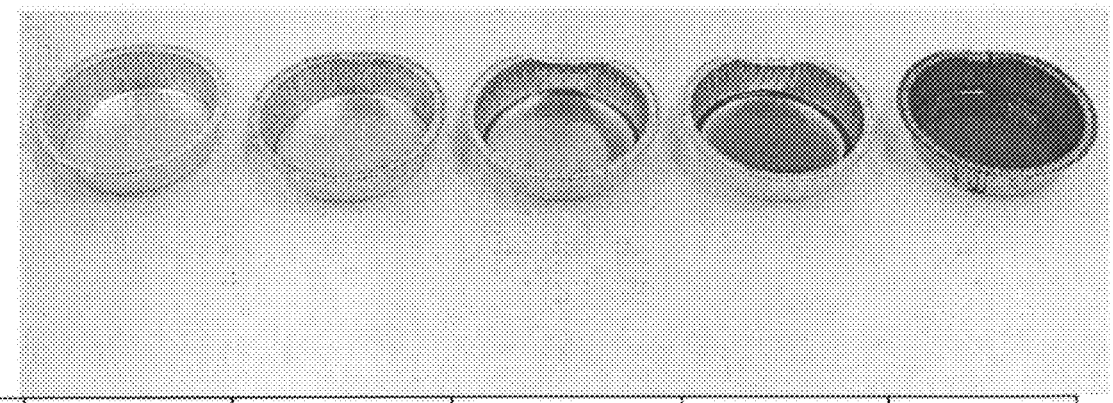
FIG. 2 shows an example of varying levels of deposit formation on pans used in a pan test.

Photographs:

After the test, pans are stored overnight at a 20 degree angle from the horizontal This allows remaining liquid to drain down and show how much sludge remains in the pan Photographs provide a permanent visual record of the deposits and sludge Accordingly, four pans were tested of the each sample listed in Table 1 (other than samples PM4 and PM5), and the results of the four pans were averaged. More specifically, pans were filled with 2 grams of sample, covered with a vented lid and held in a forced air oven for a specified time and temperature. The pans were then removed and allowed to cool. After cooling, the pans were 1) visually inspected for deposits and given a rating of 0 to 5 for the side deposits and the rim deposits at shown in FIG. 1, 0 being no deposit formation and 5 being severe deposit formation, wherein benchmarks for the amount of deposit formation are shown in FIG. 2 (the "Total Deposits" reported is the sum of the rim and side deposits), 2) the pans were weighed to determine the amount of sample that evaporated ("Evaporation"), and 3) the pans were suspended vertically, drained for ten minutes, and reweighed to determine the "Liquid Fraction," which is the amount of lubricant that was sufficiently liquid to flow out of the pan at room temperature under its own weight. Finally, the material remaining in the pan is listed as "Residue," which may be hard and solid, gummy, or viscous.

Table 2 shows the amount of total deposit formation, the percentage of the original sample that evaporated, the percentage of the original sample did not drain, and the percentage of the original sample that remained a liquid fraction, for each of the high temperature lubricant samples of Table 1 when pan tested at 240° C. in air for a period of 68 hours. Similarly, Table 3 shows the amount of total deposit formation, the percentage of the original sample that evaporated, the percentage of the original sample that did not drain, and the percentage of the original sample that remained a liquid fraction for each of the high temperature lubricant samples of Table 1 after subjecting the samples to a pan test at 260° C. in air for 20 hours.

TABLE 2

Results for Pan Test at 240° C. for 68 hours

| Samples | PM1 | PM2 | RD1 | RD2 | RD3 | COM 1 | COM2 | COM3 |
|---|---|---|---|---|---|---|---|---|
| Total Deposits | 1.5 | 2 | 5 | 6 | 6.5 | 5.5 | 2.8 | 4 |
| Evaporation | 23% | 25% | 29% | 15% | 28% | 23% | 56% | 52% |
| Residue | 20% | 22% | 16% | 41% | 32% | 77% | 43% | 45% |
| Liquid Fraction | 58% | 53% | 54% | 44% | 41% | 0% | 2% | 4% |

TABLE 3

Results for Pan Test at 260° C. for 20 hours

| Samples | PM1 | PM2 | RD1 | RD2 | RD3 | COM 1 | COM2 | COM3 |
|---|---|---|---|---|---|---|---|---|
| Total Deposits | 2.3 | 3 | 5.5 | 6.6 | 6.5 | 6.6 | 2.8 | 4.6 |
| Evaporation | 15% | 17% | 20% | 9% | 18% | 13% | 34% | 32% |
| Residue | 14% | 15% | II% | 14% | 14% | 19% | 28% | 27% |
| Liquid Fraction | 71% | 69% | 69% | 77% | 68% | 69% | 38% | 41% |

The inventive compositions performed consistently well in these two high temperature tests. The pan test method is intended to replicate conditions experienced by the high temperature lubricant in industrial application, wherein the remaining liquid fraction indicates the effective lubrication present under the high temperature conditions. Here, the inventive compositions performed well and demonstrated a high liquid fraction remaining in both tests, and particularly in the extended 68 hour test. Further, the inventive compositions demonstrated low total deposit formation relative to the comparative samples, and had soft or gummy deposits, whereas the comparative compositions tended to have hard deposits, which is an undesirable drawback of conventional high temperature lubricant compositions. While some comparative compositions demonstrated a high liquid fraction, such samples suffered the drawback of having high total deposit formation. Conversely, other comparative compositions had a relatively low deposit formation but suffered the drawback of having high evaporation and low liquid fraction.

Example 4: Varnish Panel Test of High Temperature Lubricant Samples

Figure 3:
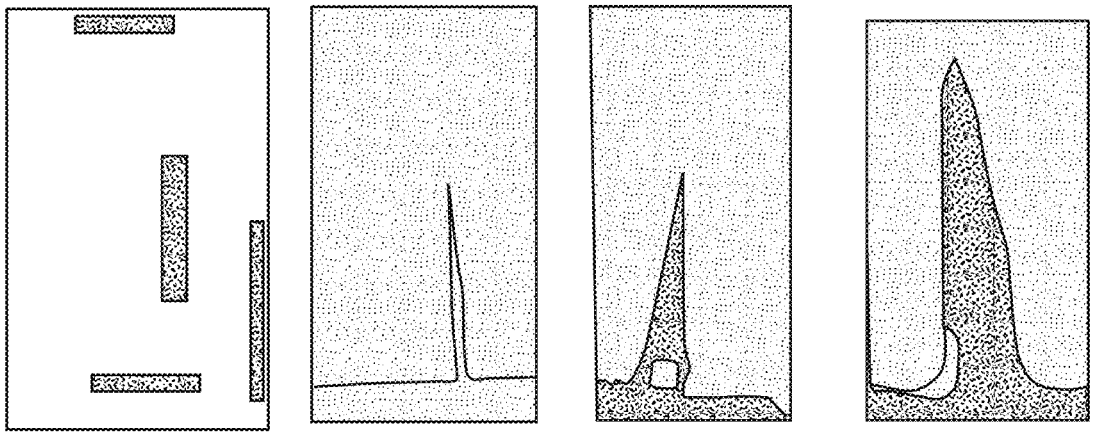
FIG. 3 shows the results of an example varnish panel test conducted using various lubricant compositions showing good and poor performance.

The varnish panel test provides a test method for showing deposit formation of a lubricant sample at an accelerated rate. FIG. 3 shows an example of the results of a varnish panel test conducted using lubricants having various components to demonstrate differing levels of deposit formation. The varnish panel test was conducted by tilting a hot plate at a slight angle and bringing the hot plate to a desired temperature. Here, the varnish panel test was conducted with the hot plate at a temperature of approximately 330-350° C. Once the hot plate has reached the desired temperature, an aluminum panel was positioned thereon and allowed to equilibrate for ten minutes. Once equilibrated, a sample is dripped onto the top center of the aluminum panel at a rate of one drop every thirty seconds for a period often minutes. At the end of this ten minute period, the sample was allowed to remain on the aluminum panel for an additional ten minutes, at which point the panel is removed from the hot plate for cooling.

Figure 4:
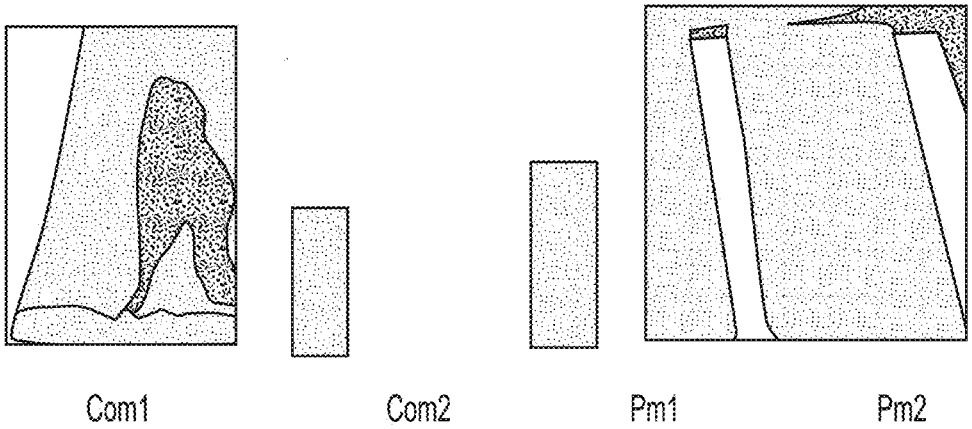
FIG. 4 shows the results of a varnish panel test conducted on the lubricant samples of the present invention.

Referring now to FIG. 4, there is shown the results of a varnish panel test. The inventive compositions were shown to burn off cleanly and produced little deposit formation. Comparative composition Com2 also burned off fairly cleanly. This is preferred as it indicates cleaner in-use application performance. In contrast, the comparative composition Com1 left a large amount of hard deposit. These results further confirm the results from Example 3 which showed PM1, PM2 and Com2 had low total deposits compared to Com 1. However, Com2 achieved low deposits with a much higher evaporation and lower liquid fraction than PM1 and PM2.

Example 5: Pan Test for Optimizing the High Temperature Lubricant Sample Composition The inventive compositions and one comparative composition were then subjected to further testing to determine an optimally performing lubricant composition with low deposit formation and a high bulk liquid fraction in high temperature application. Table 4 shows the results of a pan test (as described above in Example 3) in which samples were held at 240° C. in air for 44 hours, Table 5 shows the results of a pan test wherein the samples were held at 240° C. in air for 68 hours, and Table 6 shows the results of a pan test wherein the samples were held at 240° C. in air for 92 hours.

TABLE 4

Pan test at 240° C. for 44 hours

| | Samples | | | | |
|---|---|---|---|---|---|
| | PM1 | PM2 | PM4 | PM5 | COM1 |
| Total Deposits | 2.5 | 2 | 2.75 | 2.25 | 5.75 |
| Evaporation | 13% | 15% | 13% | 13% | 14% |
| Residue | 12% | 12% | 11% | 12% | 19% |
| Liquid Fraction | 75% | 73% | 76% | 75% | 67% |

TABLE 5

Pan test at 240° C. for 68 hours

| | Samples | | | | |
|---|---|---|---|---|---|
| | PM1 | PM2 | PM4 | PM5 | COM1 |
| Total Deposits | 2 | 2.75 | 2.25 | 2.5 | 7 |
| Evaporation | 25% | 29% | 25% | 25% | 27% |
| Residue | 21% | 29% | 20% | 25% | 73% |
| Liquid Fraction | 54% | 42% | 55% | 50% | 0% |

TABLE 6

Pan test at 240° C. for 92 hours

| | Samples | | | | |
|---|---|---|---|---|---|
| | PM1 | PM2 | PM4 | PM5 | COM1 |
| Total Deposits | 2.75 | 4.5 | 2.25 | 3.75 | 7 |
| Evaporation | 37% | 42% | 36% | 35% | 33% |
| Residue | 46% | 57% | 43% | 56% | 67% |
| Liquid Fraction | 17% | 1% | 21% | 9% | 0% |

The inventive compositions where shown to have improved performance and had a higher liquid fraction and lower total deposits than the comparative composition, Com1. PM1 and PM4 demonstrated the highest remaining liquid fraction in each test. PM1 and PM4 demonstrated low deposit formation relative to the comparative standard, Com1, particularly during the tests conducted at extended periods of 68 and 92 hours.

Figure 5:
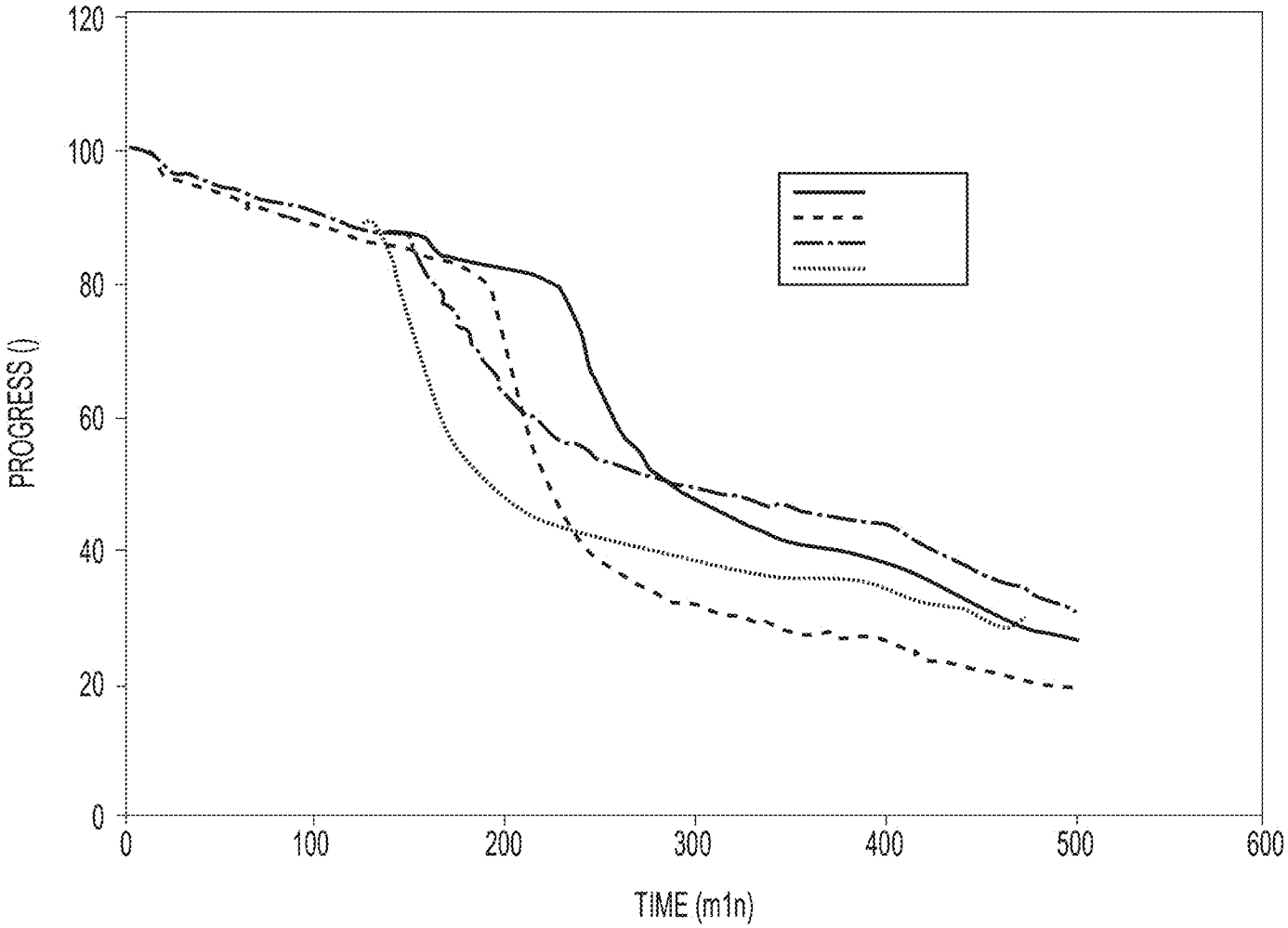
FIG. 5 shows the results of a thermogravimetric analysis (TGA) for the lubricant compositions of the present invention.

Example 6: Thermogravimetric Analysis of Lubricant Compositions of the Present Invention Thermogravimetric Analysis (TGA) was performed on the inventive compositions (PM1, PM2, PM4, and PM5) to assess the thermal stability of each sample. The results are shown in FIG. 5. Of the samples, PM4 is the second sample to evaporate as shown by the change in percent weight loss at approximately 150 minutes in FIG. 5. PM4 demonstrated a more gradual percent weight loss than the remaining samples and finished the test with the least weight loss. This indicates a high thermal stability and less evaporation under constant high temperature application.

Example 7: Inventive High Temperature Lubricant Composition Sample

In one embodiment, the inventive composition includes the components as shown in Table 7 and is formed by the method outlined below.

TABLE 7

Example High Temperature Lubricant Composition

| Chemical Composition | Weight Percent (%) |
|---|---|
| Polyol Ester | 32.5 |
| Pyromellitate Ester | 64.1 |
| Triaryl Phosphorothionate | 0.2 |
| Amine Phosphate Mixture | 0.1 |
| Azole corrosion inhibitor | 0.1 |
| Alkylated phenyl-alpha-naphthylamine | 1.5 |
| Alkylated diphenylamine | 1.5 |

To form the lubricant composition, the base oils, the polyol ester and the pyromellitate ester were added into a tank and heated with agitation to a temperature of 80° C. to 85° C. to promote dissolution. The additives, a triaryl phosphorothionate, an azole corrosion inhibitor, an alkylated phenyl-alpha-naphthyl amine, and an alkylated diphenylamine, were then mixed into the solution. The mixture was then cooled to a temperature of 60° to 65° C. to allow for another additive, amine phosphate mixture to be added to and dissolved into the solution. The kinematic viscosity at 40° C. was then verified such that it is within the ISO 220 grade (i.e., 220 centistokes±10 percent) of 198 to 242 centistokes. The solution can then be filtered and packaged.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A lubricant composition, comprising:

a base oil comprising a mixture of at least one polyol ester and at least one pyromellitate ester, wherein the polyol ester is present in an amount of about 32% to about 36% by weight of the lubricant composition and the pyromellitate ester is present in an amount of about 63% to about 65% by weight of the lubricant composition, and one or more additives, wherein, after at least 68 hours at a temperature of 240° C., the lubricant composition has a liquid fraction of at least about 50 percent.

2. The lubricant composition of claim 1, wherein, after at least 68 hours at a temperature of 240° C., the lubricant composition has evaporation of about 15 percent or less.

3. The lubricant composition of claim 1, wherein the at least one polyol ester comprises a pentaerythritol ester, a dipentaerythritol ester, or a mixture thereof.

4. The lubricant composition of claim 1, wherein the at least one polyol ester comprises a dipentaerythritol ester having a structure according to the following formula:

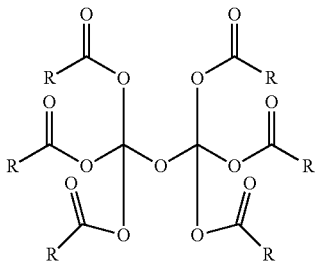

wherein each R group is a linear or branched, saturated alkyl group having between about 4 and about 10 carbon atoms.

5. The lubricant composition of claim 4, wherein at least one R group is a linear, saturated alkyl group, and wherein at least one R group is a branched, saturated alkyl group.

6. The lubricant composition of claim 1, wherein the pyromellitate ester has a structure according to the following formula:

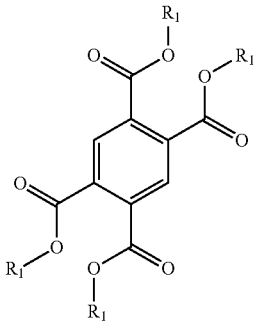

wherein $R_1$ is a branched or unbranched, saturated alkyl group having about 3 to about 15 carbon atoms.

7. The lubricant composition of claim 1, wherein the pyromellitate ester is selected from the group consisting of tetraisopropyl pyromellitate, tetra 2-ethylhexyl pyromellitate, tetraheptyl pyromellitate, tetraoctyl pyromellitate, tetranonyl pyromellitate, tetradecyl pyromellitate, tetraisodecyl pyromellitate, tetra isononyl pyromellitate, tetra isooctyl pyromellitate, tetrabutyl pyromellitate, tetra isobutyl pyromellitate, and combinations thereof.

8. The lubricant composition of claim 1, further having a kinematic viscosity at about 40° C. of about 90 to about 250 centistokes.

9. The lubricant composition of claim 1, wherein the one or more additive is selected from the group consisting of at least one antioxidant, an extreme pressure additive, an anti-wear additive, an anti-rust additive, and a corrosion inhibitor.

10. A lubricant composition, comprising:

a base oil comprising:

about 32% to about 36% of at least one polyol ester having a structure according to the following formula (I):

(I)

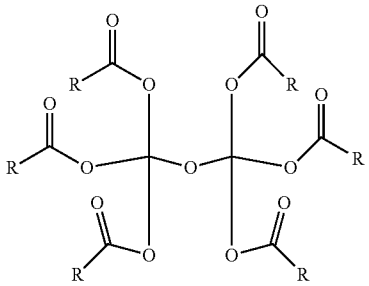

wherein each R group is a linear or branched, saturated alkyl group having between about 4 and about 10 carbon atoms; and about 63 percent to about 65 percent of at least one pyromellitate ester having a structure according to the following formula:

(II)

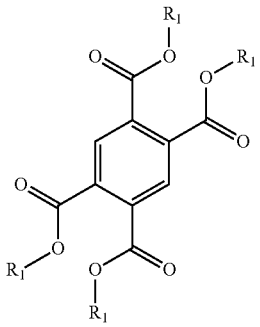

wherein $R_1$ is a branched or unbranched, saturated alkyl group having about 3 to about 15 carbon atoms, and one or more additives, wherein the lubricant composition has a kinematic viscosity at about 40° C. of about 198 to about 242 centistokes.

11. The lubricant composition of claim 10, wherein, after at least 68 hours at a temperature of 240° C., the lubricant composition has a liquid fraction of at least about 50 percent.

12. The lubricant composition of claim 11, wherein, after at least 68 hours at a temperature of 240° C., the lubricant composition has evaporation of about 15 percent or less.

13. The lubricant composition of claim 10, wherein $R_1$ has about 3 to about 13 carbon atoms.

14. The lubricant composition of claim 10, wherein the at least one pyromellitate ester is present in an amount of about 63 percent to about 65 percent by weight of the composition.

15. A lubricant composition, comprising:

a base oil comprising:

about 32% to about 36% of at least one polyol ester comprising a pentaerythritol ester, a dipentaerythritol ester, or a mixture thereof;

about 63 percent to about 65 percent of at least one pyromellitate ester having a structure according to the following formula:

(II)

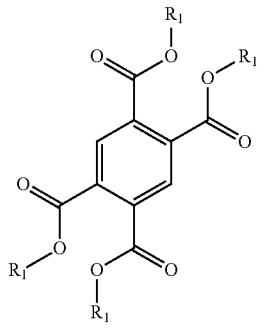

wherein $R_1$ is a branched or unbranched, saturated alkyl group having about 3 to about 15 carbon atoms, wherein the lubricant composition has a kinematic viscosity at about 40° C. of about 90 to about 250 centistokes, and one or more additives, wherein, after at least 68 hours at a temperature of 240° C., the lubricant composition has a liquid fraction of at least about 50 percent and evaporation of about 15 percent or less.

16. The lubricant composition of claim 15, wherein the at least one pyromellitate ester comprises tetra 2-ethylhexyl pyromellitate.

17. The lubricant composition of claim 15, wherein the at least one pyromellitate ester comprises tetraisopropyl pyromellitate, tetraheptyl pyromellitate, tetraoctyl pyromellitate, tetranonyl pyromellitate, tetradecyl pyromellitate, tetraisodecyl pyromellitate, tetra isononyl pyromellitate, tetra isooctyl pyromellitate, tetrabutyl pyromellitate, tetra isobutyl pyromellitate, or combinations thereof.

18. The lubricant composition of claim 1, wherein the base oil comprises 96-98% of the total weight of the lubricant composition.

* * * * *